US010624432B2

(12) United States Patent
Gea

(10) Patent No.: US 10,624,432 B2
(45) Date of Patent: Apr. 21, 2020

(54) CHANGEABLE BAG

(71) Applicant: Ji Hyun Gea, Osan-si (KR)

(72) Inventor: Ji Hyun Gea, Osan-si (KR)

( * ) Notice: Subject to any disclaimer, the term of this patent is extended or adjusted under 35 U.S.C. 154(b) by 0 days.

(21) Appl. No.: 15/753,974

(22) PCT Filed: Aug. 23, 2016

(86) PCT No.: PCT/KR2016/009343

§ 371 (c)(1),
(2) Date: Feb. 21, 2018

(87) PCT Pub. No.: WO2017/034305

PCT Pub. Date: Mar. 2, 2017

(65) Prior Publication Data

US 2018/0242706 A1 Aug. 30, 2018

(30) Foreign Application Priority Data

Aug. 24, 2015 (KR) ..... 10-2015-0118690
Aug. 24, 2015 (KR) ..... 10-2015-0118773

(51) Int. Cl.

| | |
|---|---|
| ***A45C 13/08*** | (2006.01) |
| ***A45C 3/06*** | (2006.01) |
| ***A45C 13/00*** | (2006.01) |
| ***A45C 3/00*** | (2006.01) |
| ***A45C 13/10*** | (2006.01) |

(52) U.S. Cl.

CPC ..... *A45C 13/08* (2013.01); *A45C 3/00* (2013.01); *A45C 3/06* (2013.01); *A45C 13/00* (2013.01); *A45C 13/1092* (2013.01); *A45C 2013/1015* (2013.01)

(58) Field of Classification Search

CPC .. A45C 13/08; A45C 13/1092; A45C 13/1015
USPC ..... 150/104, 105
See application file for complete search history.

(56) References Cited

U.S. PATENT DOCUMENTS

| | | | | |
|---|---|---|---|---|
| 8,684,053 | B2 | 4/2014 | Platt et al. | |
| 2001/0015248 | A1* | 8/2001 | McCreery | A45C 3/08 150/104 |
| 2009/0151826 | A1* | 6/2009 | Baxter | A45C 1/024 150/104 |

(Continued)

FOREIGN PATENT DOCUMENTS

| | | | |
|---|---|---|---|
| JP | 2012-085705 | A | 5/2012 |
| JP | 2013-202097 | A | 10/2013 |

(Continued)

OTHER PUBLICATIONS

International Search Report for PCT/KR2016/009343 dated Jan. 4, 2017 from Korean Intellectual Property Office.

*Primary Examiner* — Sue A Weaver
(74) *Attorney, Agent, or Firm* — Revolution IP, PLLC

(57) ABSTRACT

A changeable bag includes a first bag body having a first accommodating portion; a second bag body having a second accommodating portion accommodating the first bag body; and a coupling portion that detachably couples the first bag body accommodated in the second bag body to the second bag body, wherein the coupling portion includes a bottom coupling portion that detachably couples a bottom of the first bag body and a bottom of the second bag body.

3 Claims, 17 Drawing Sheets

(56) References Cited

U.S. PATENT DOCUMENTS

| | | | | |
|---|---|---|---|---|
| 2009/0188592 | A1* | 7/2009 | Connacher | A45C 3/001 150/105 |
| 2011/0000590 | A1* | 1/2011 | Welch | A45C 3/06 150/104 |
| 2012/0125496 | A1* | 5/2012 | Hedaya | A45C 3/08 150/104 |
| 2013/0133795 | A1* | 5/2013 | Zhou | A45C 13/30 150/104 |
| 2014/0083577 | A1* | 3/2014 | Cleveland | A45F 3/02 150/105 |
| 2014/0150936 | A1* | 6/2014 | Goodale | A45C 3/08 150/105 |
| 2014/0373985 | A1* | 12/2014 | Pace | A45C 3/001 150/105 |

FOREIGN PATENT DOCUMENTS

| | | | |
|---|---|---|---|
| KR | 20-2011-0007570 | U | 8/2011 |
| KR | 10-2012-0010262 | A | 2/2012 |
| KR | 10-1273423 | B1 | 6/2013 |

* cited by examiner

【FIG. 1】
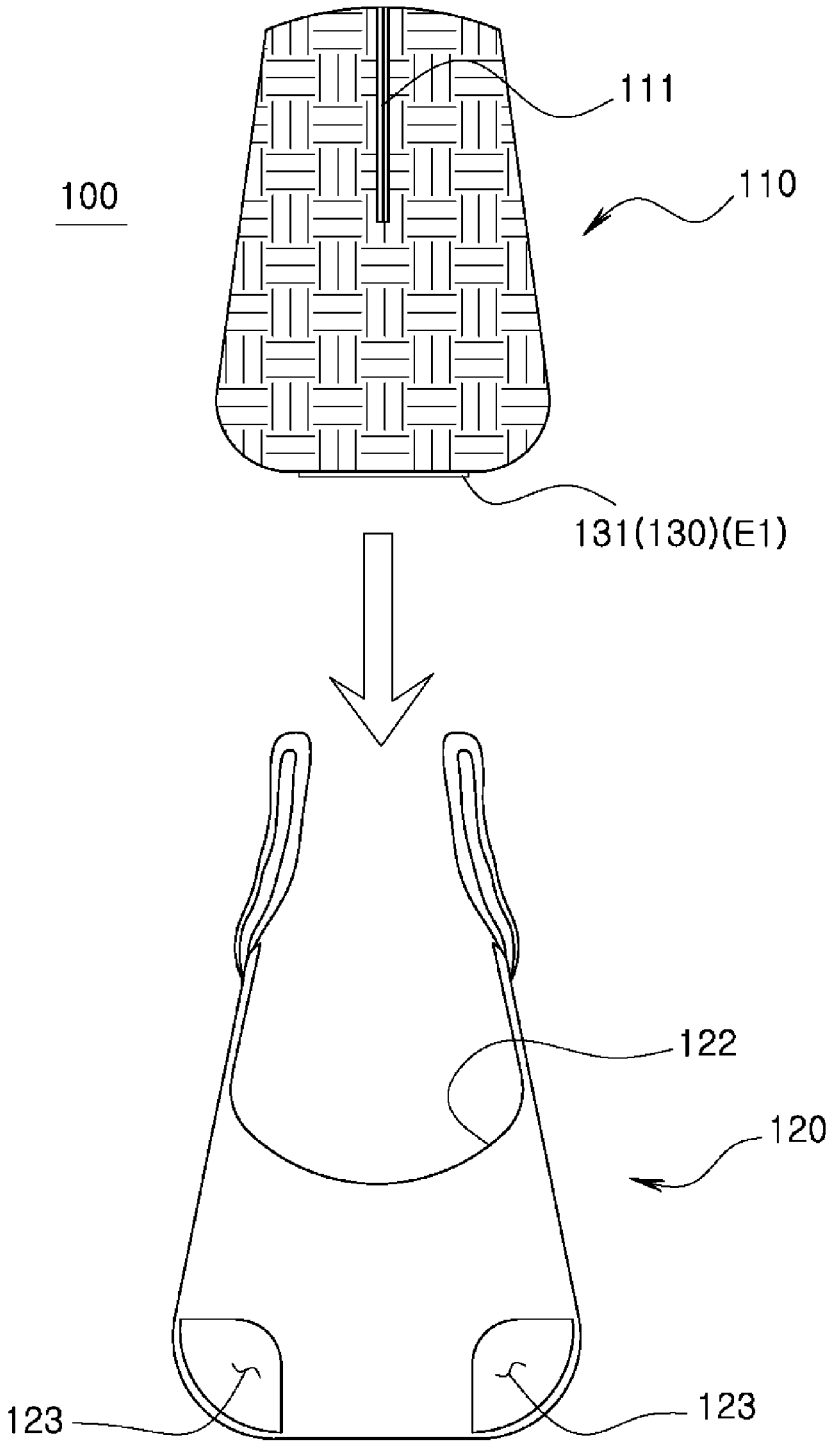

【FIG. 2】
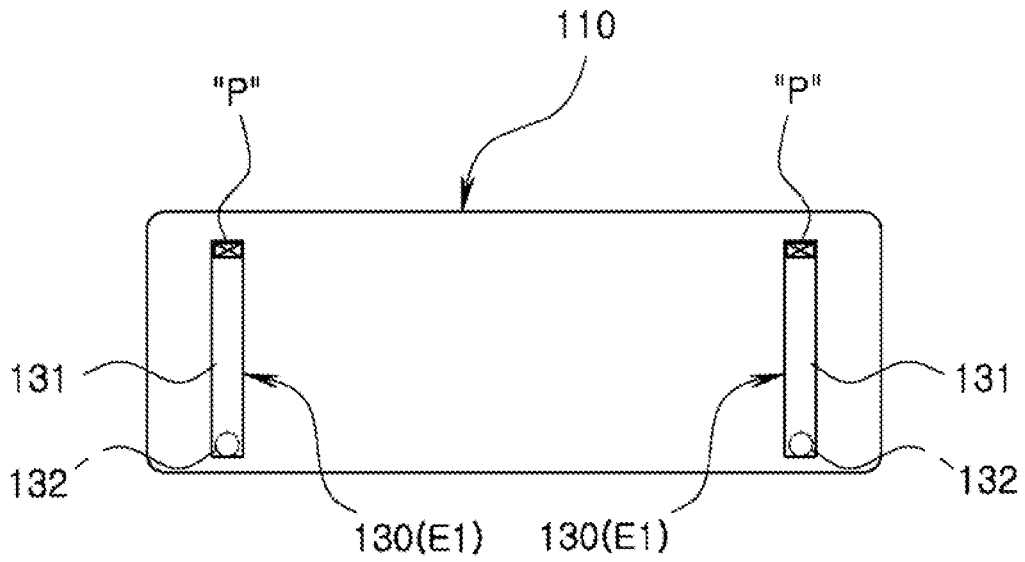
(a)
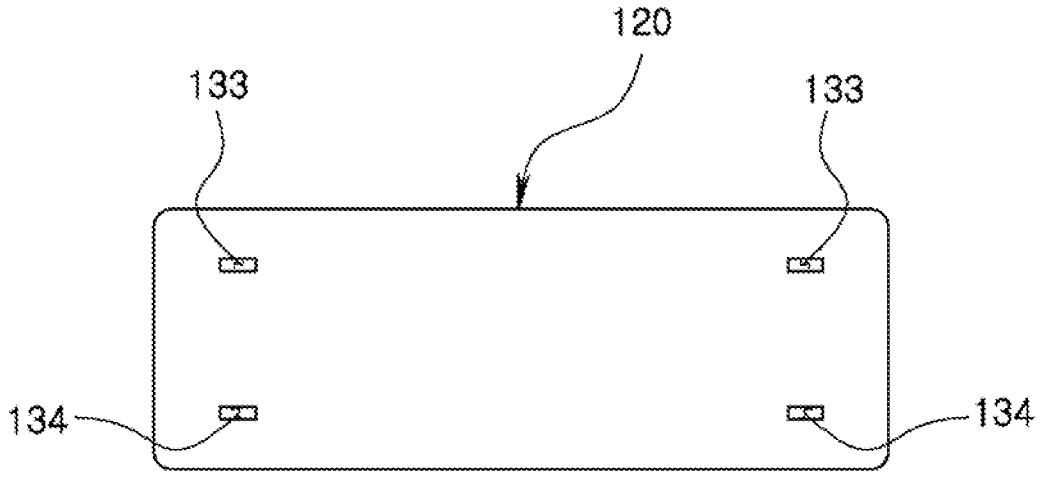
(b)

【FIG. 3】
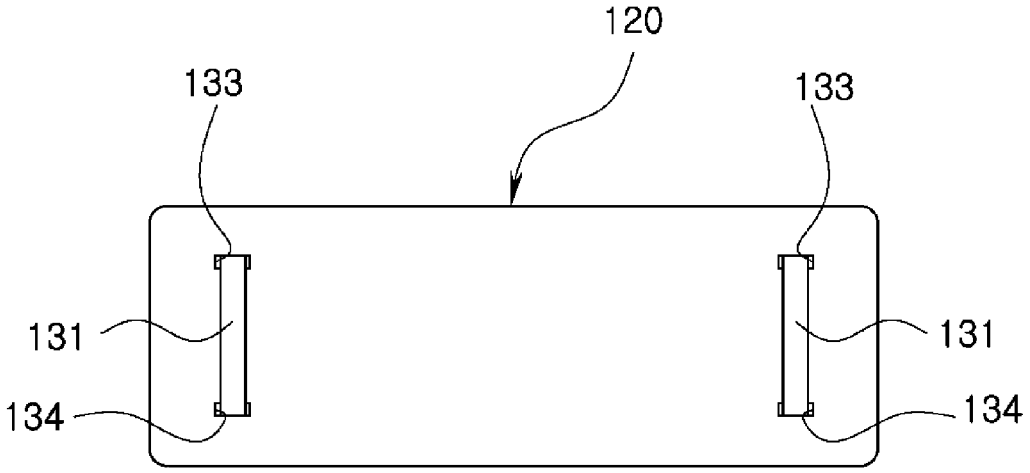
【FIG. 4】
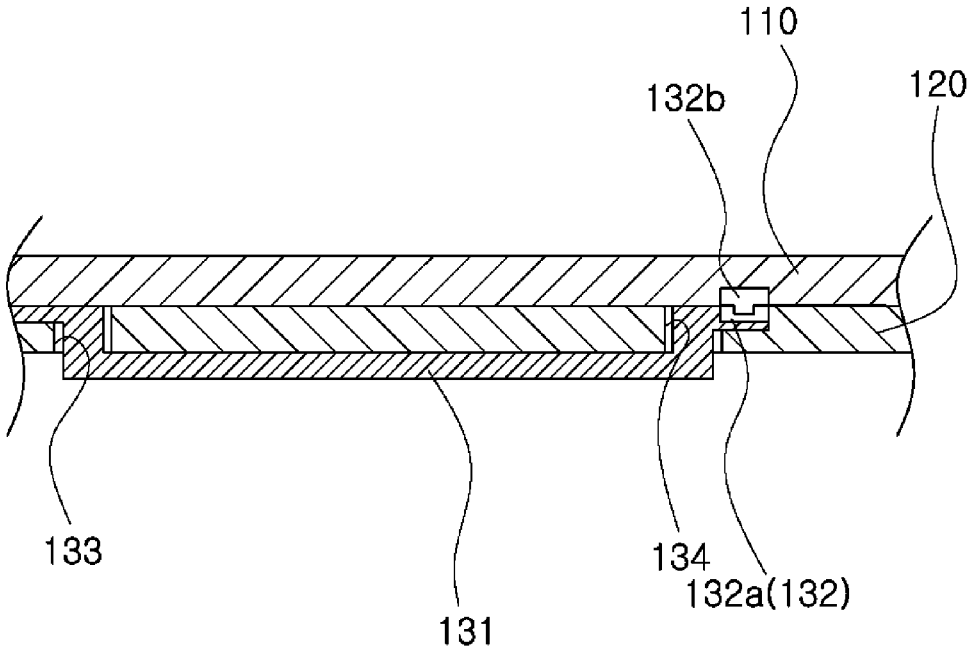

【 FIG. 5 】
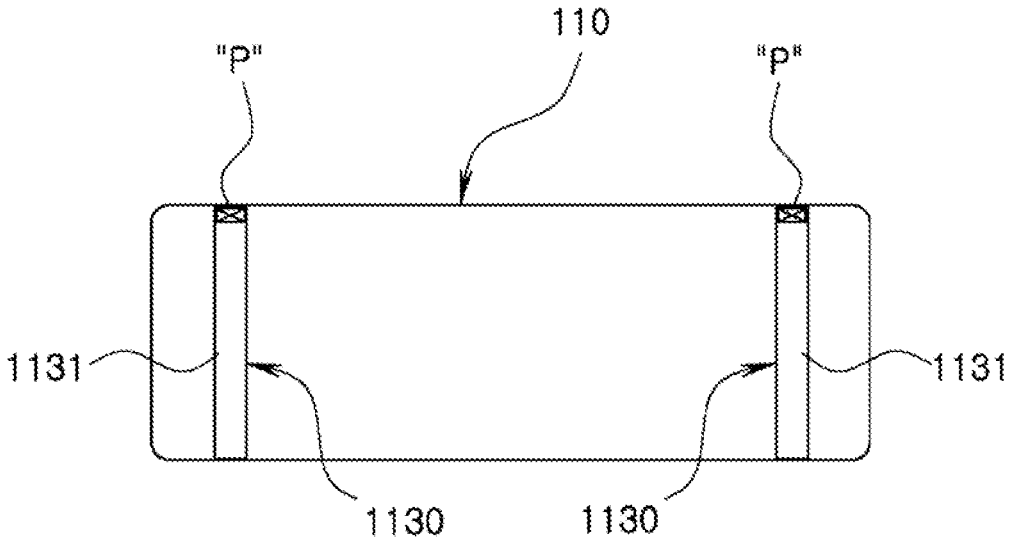
(a)
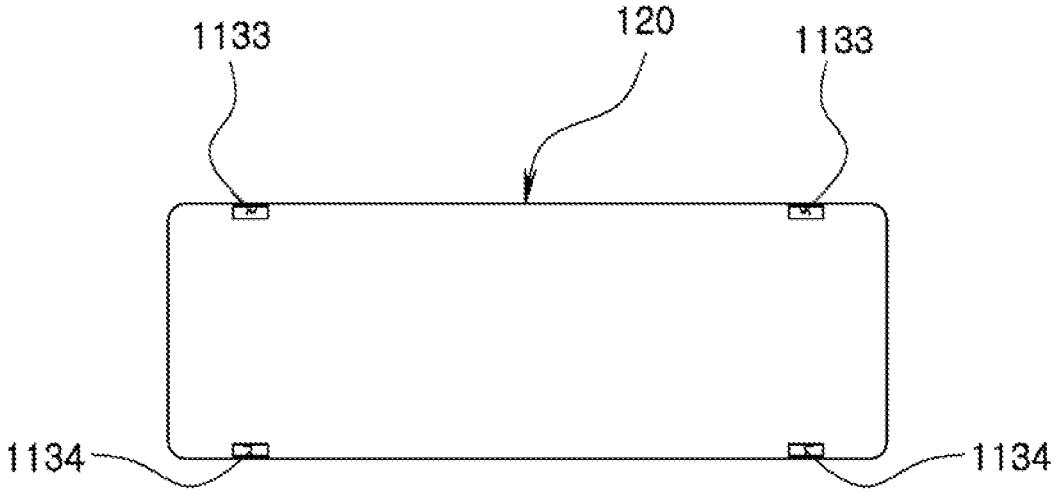
(b)

【FIG. 6】
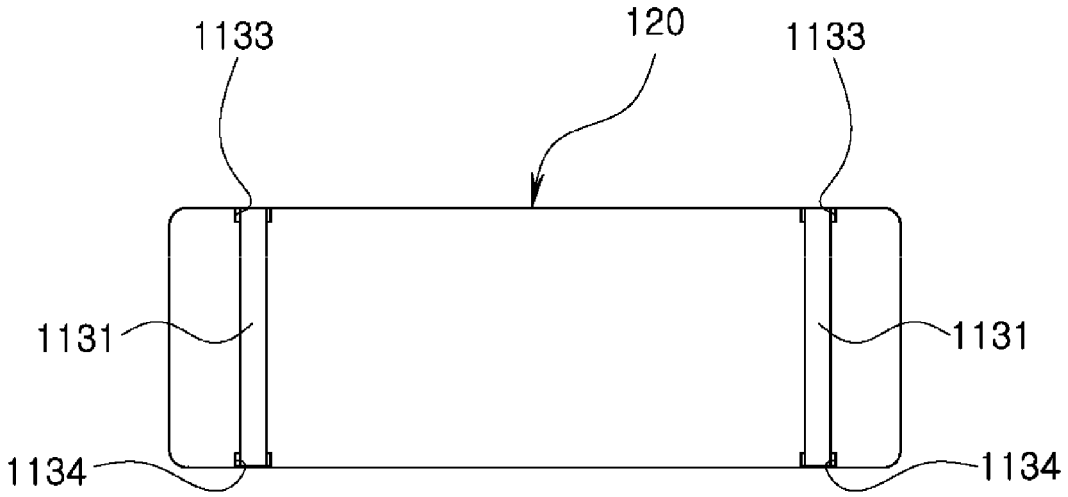

【FIG. 7】
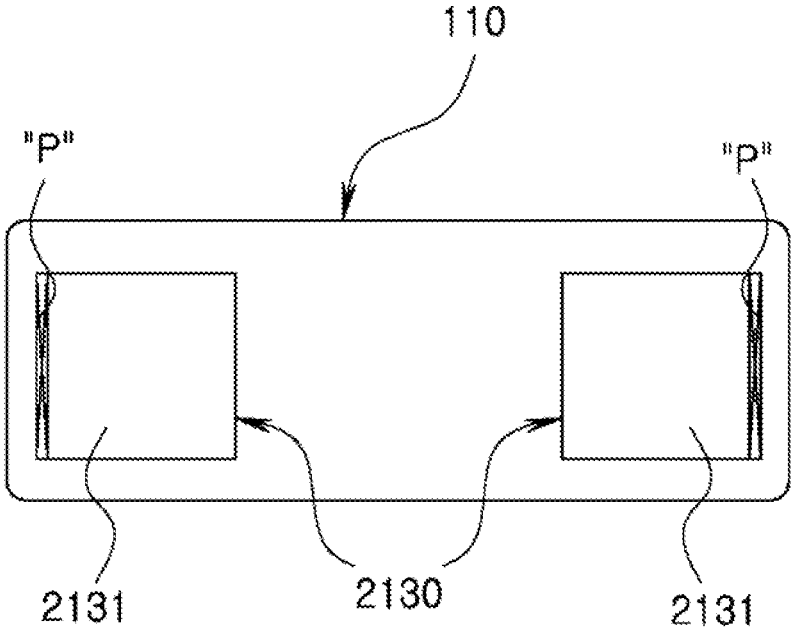
(a)
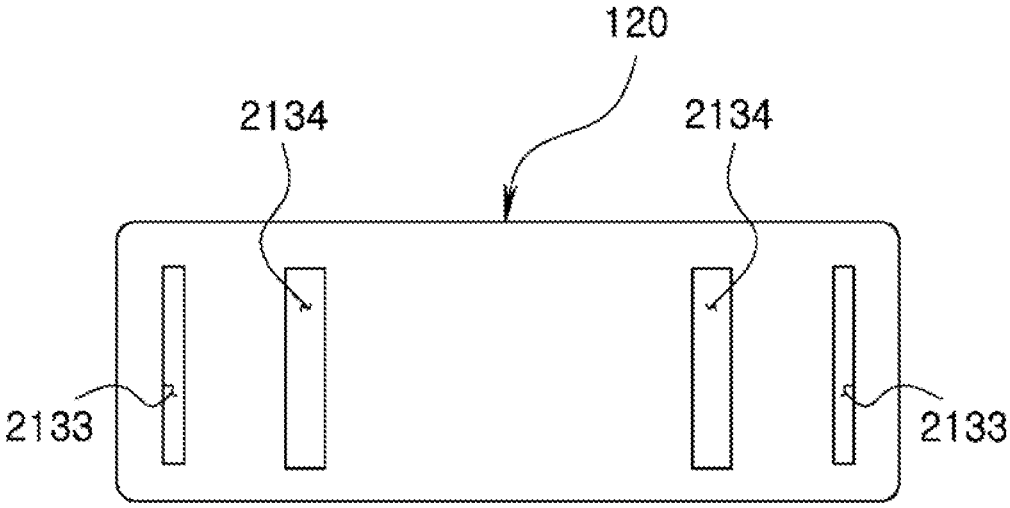
(b)

【 FIG. 8 】
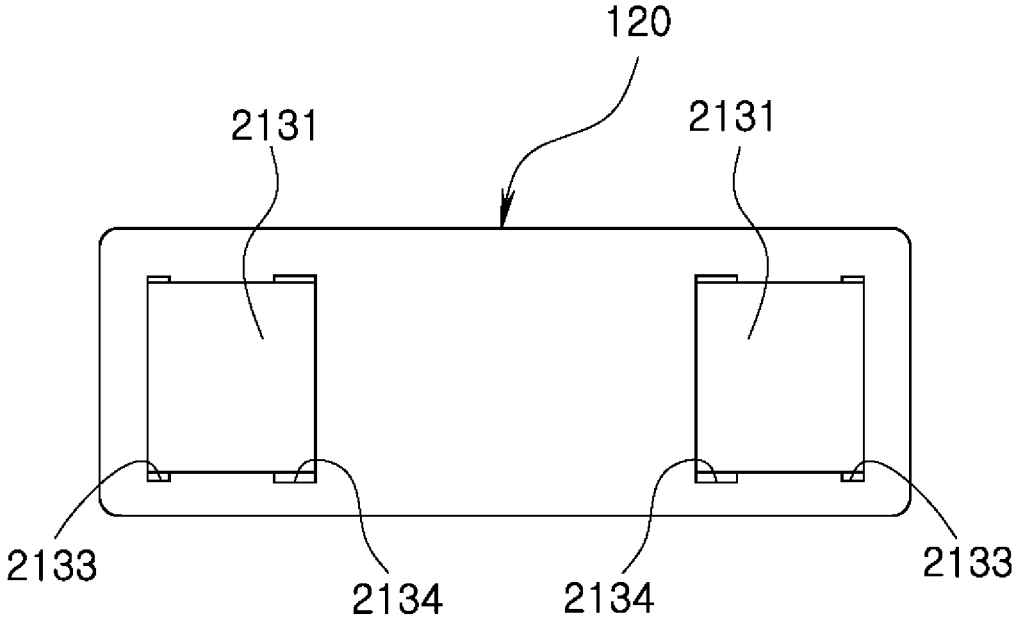

【FIG. 9】
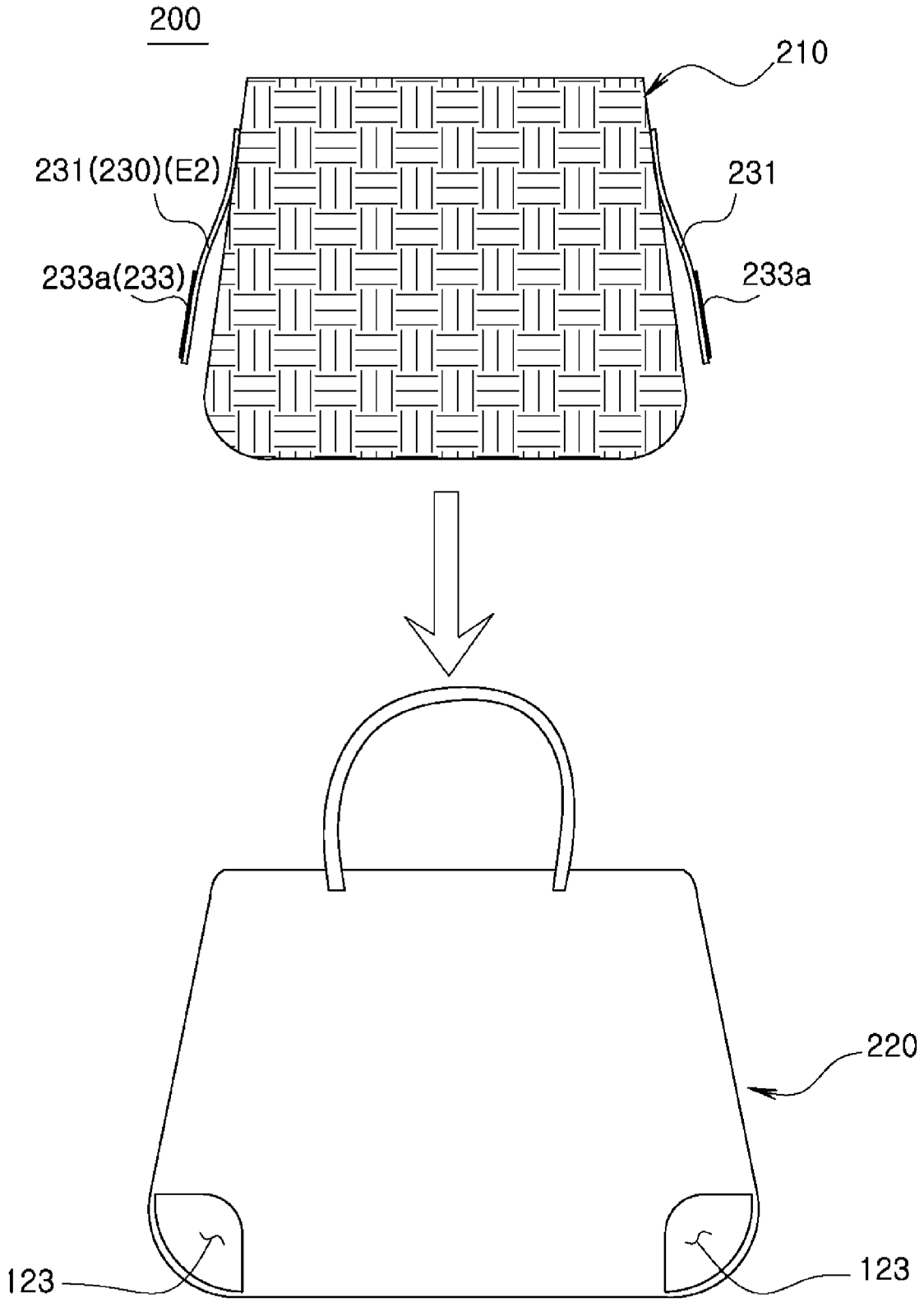

【FIG. 10】
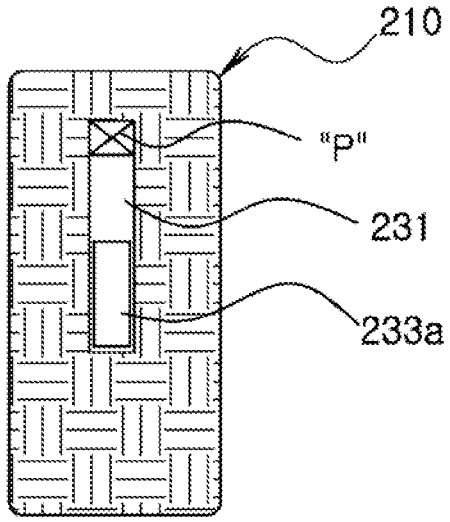
(a)
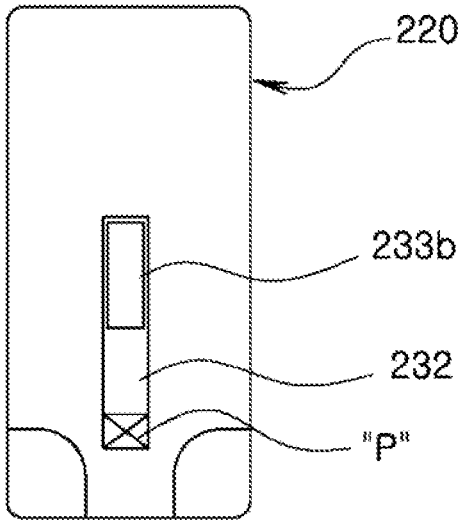
(b)

【FIG. 11】
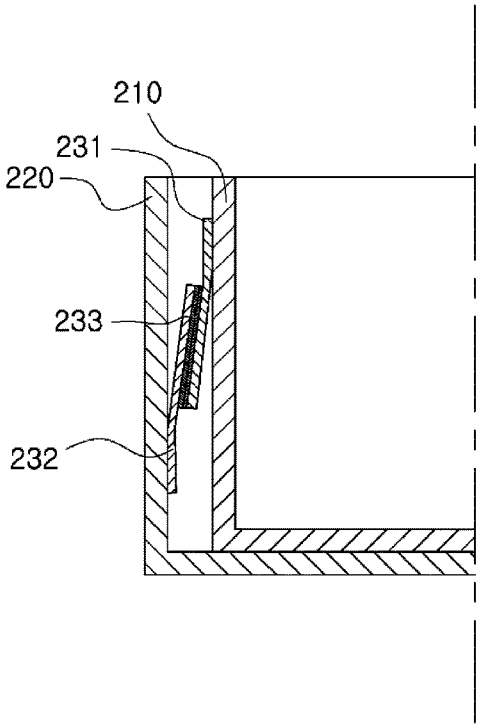
【FIG. 12】
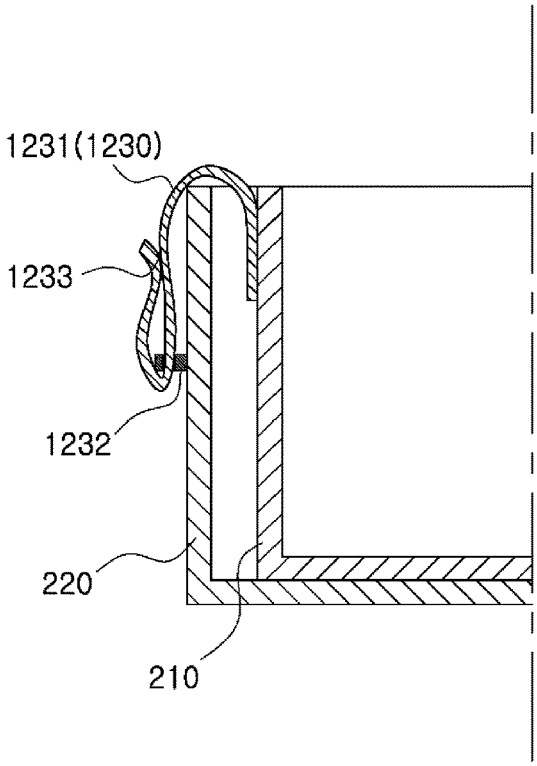

【FIG. 13】
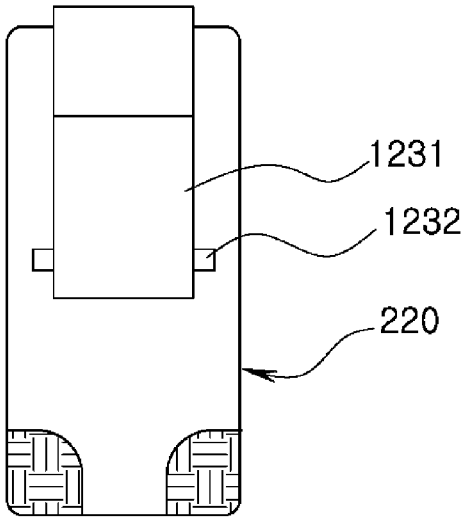
【FIG. 14】
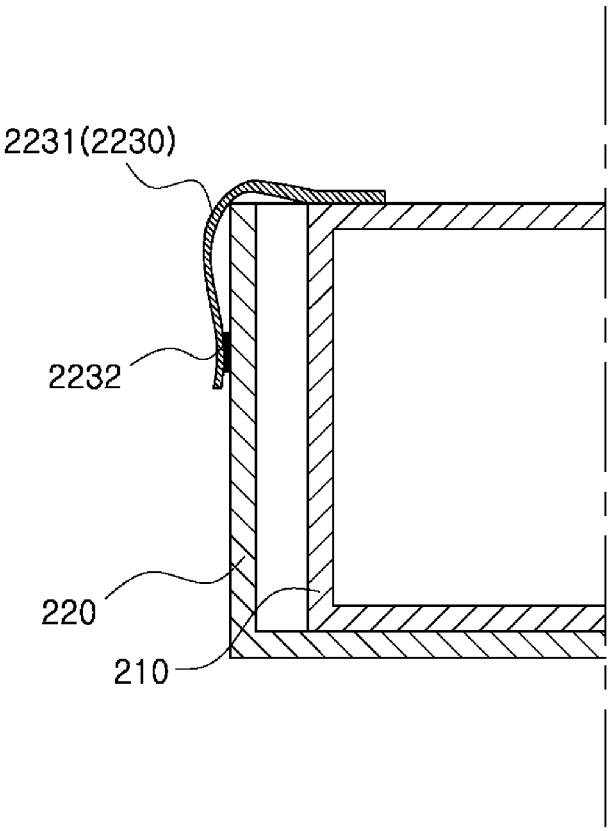

【FIG. 15】
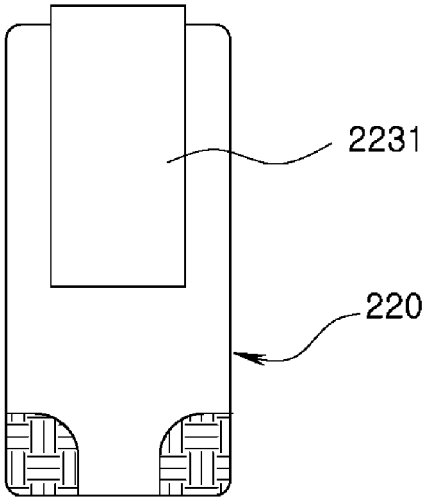
【FIG. 16】
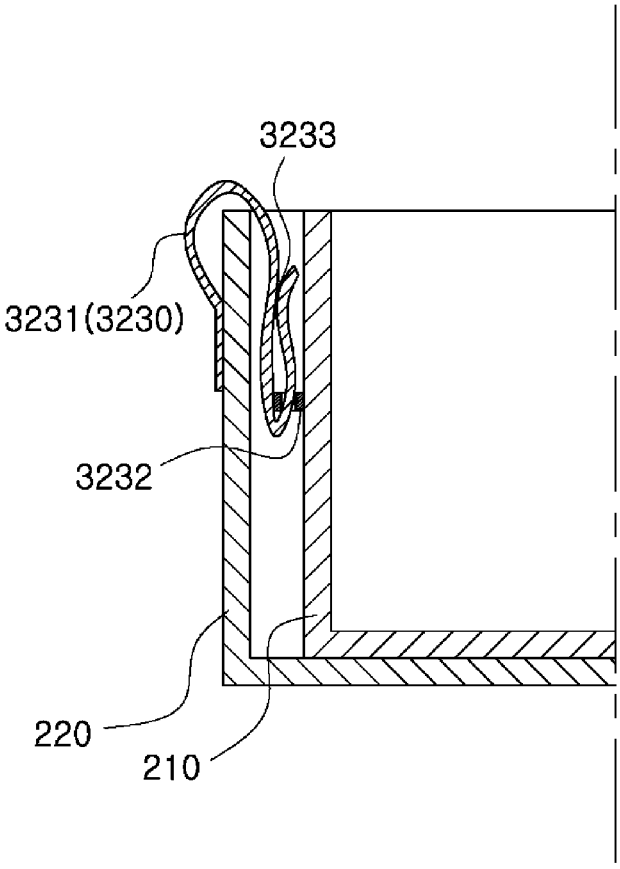

【FIG. 17】
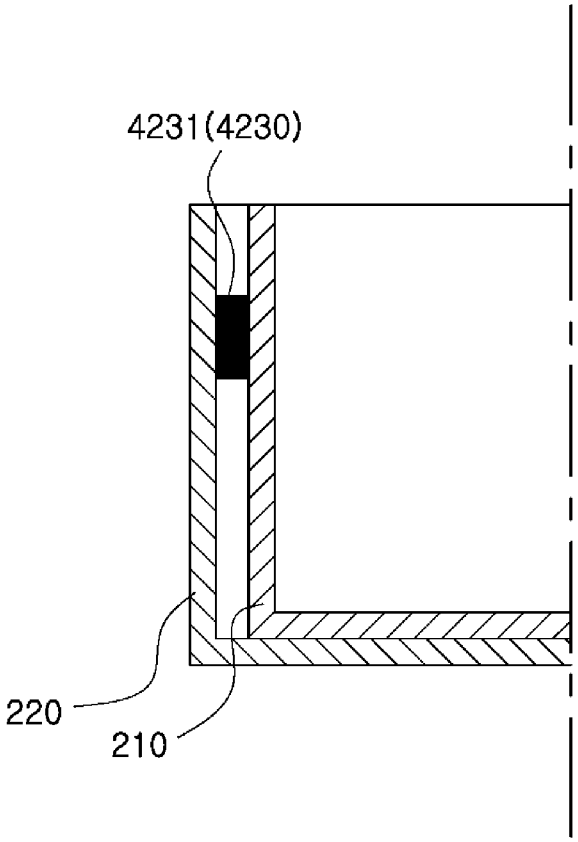

【FIG. 18】
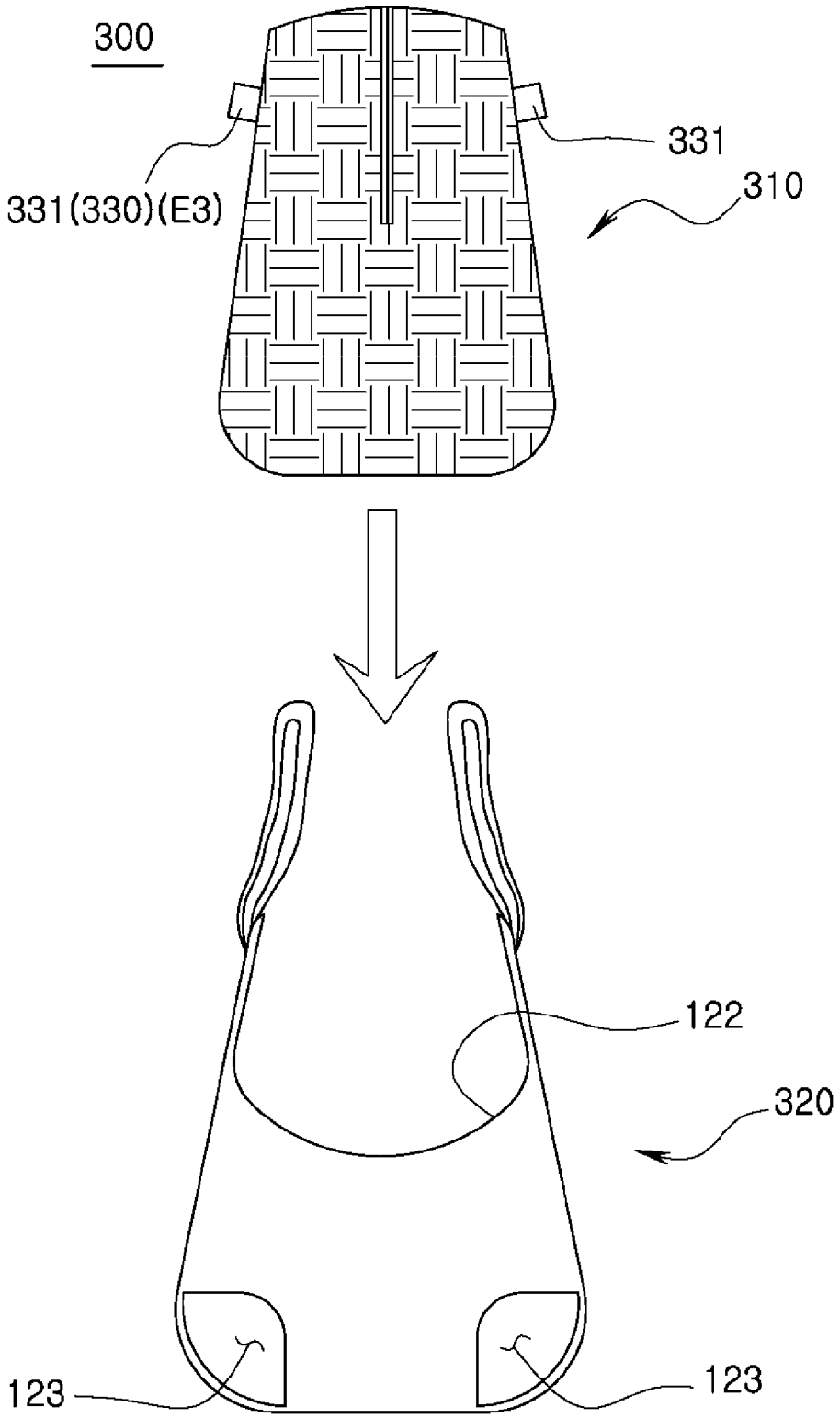

【FIG. 19】
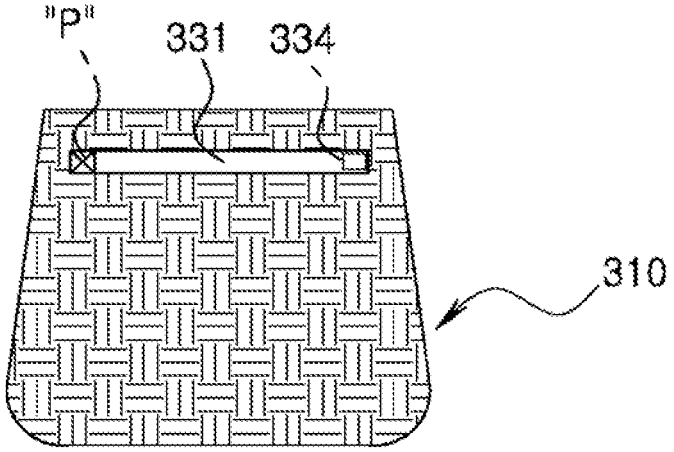
(a)
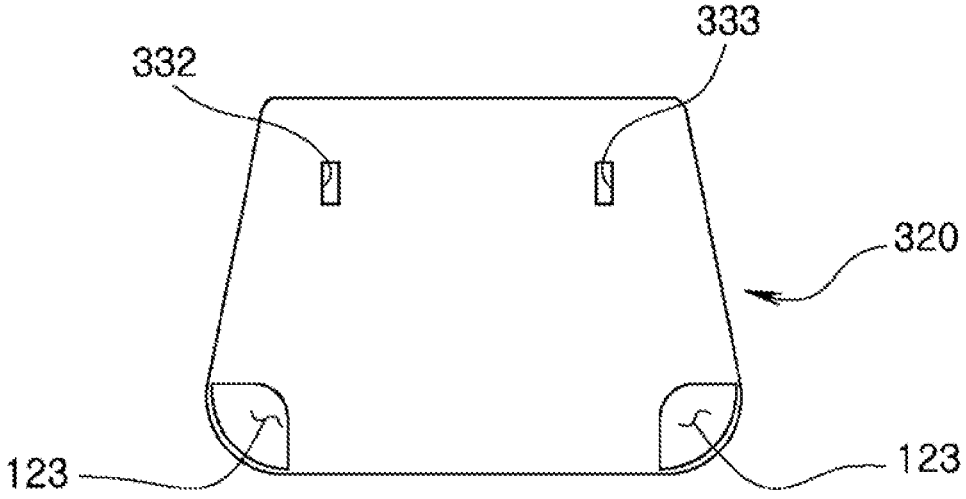
(b)

【FIG. 2 0】
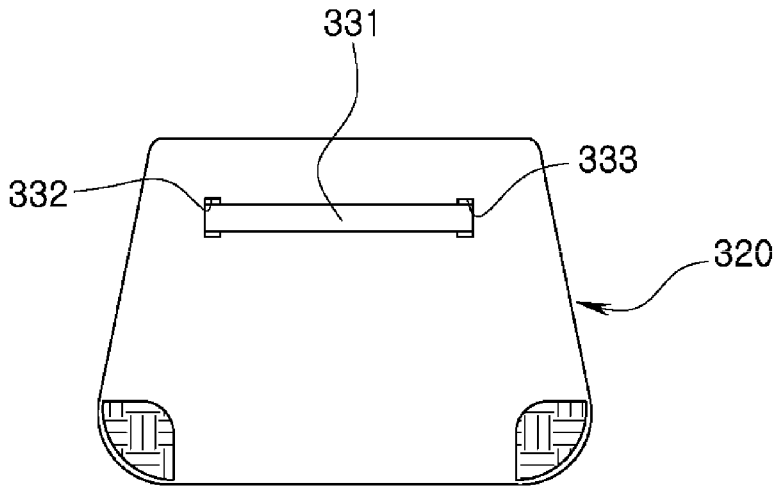
【FIG. 2 1】
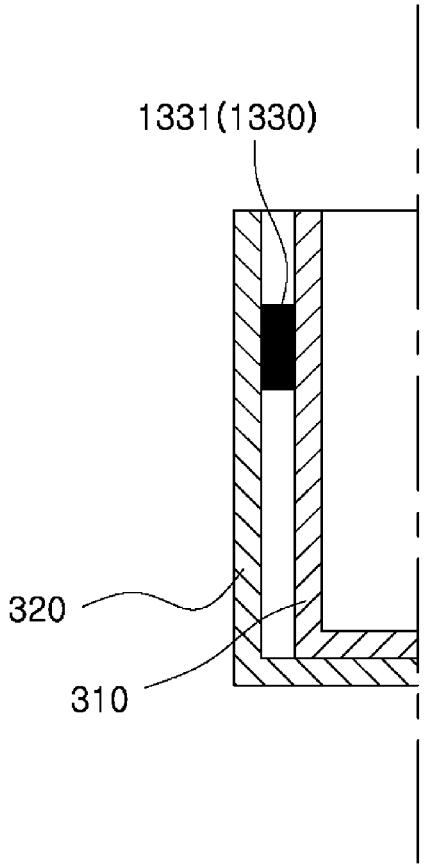

【FIG. 2 2】
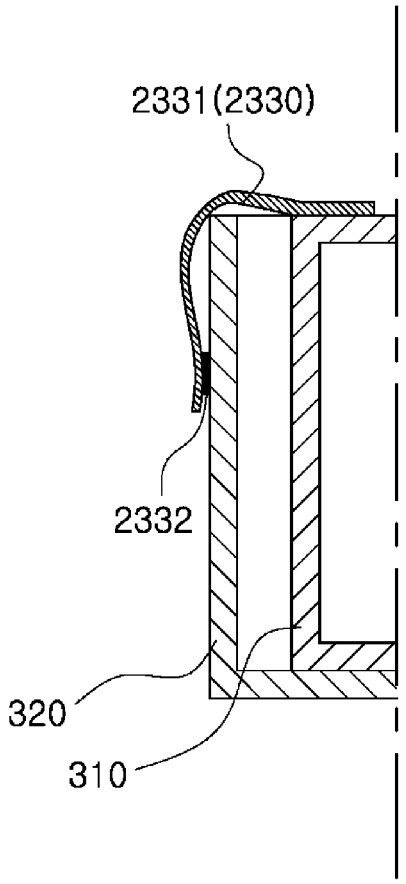
【FIG. 2 3】
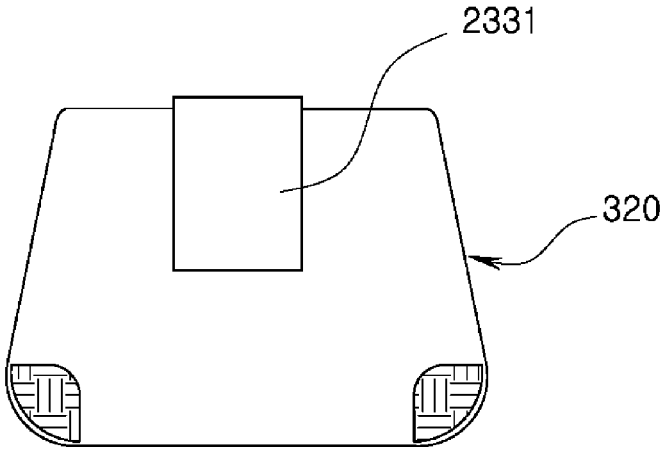

CHANGEABLE BAG

TECHNICAL FIELD

The present invention relates to a bag that is changeable to different types, different shapes, or different colors.

BACKGROUND ART

Generally, a bag is a tool which is made of leather, cloths, vinyl, artificial leather, and the like to conveniently put and carry goods, and includes a pouch, a tote bag, a shoulder bag, and the like according to a type thereof.

The pouch is designed to be opened and closed with a zipper and the like and conveniently put into a bag and carried without a handle or put in the armpit and carried. The tote bag is designed to have an upper opening portion, open and close the upper opening portion with a zipper and the like, and be carried in hand with two handles. In addition, the shoulder bag is designed to have an upper opening portion, open and close the upper opening portion with a cover, a zipper, or the like, and be carried to be hung on the shoulder with a shoulder strap.

However, these bags are manufactured so that the types, the shapes, or the colors thereof cannot be changed, and thus there is a problem in that the bags cannot be changed depending on your taste in the present society where the personality is important.

DISCLOSURE

Technical Problem

A technical object of the present invention is to provide a changeable bag capable of changing different types, different shapes, different colors, or the like.

Technical Solution

In order to achieve the object, according to an exemplary embodiment of the present invention, there is provided a changeable bag including: a first bag body having a first accommodating portion; a second bag body having a second accommodating portion accommodating the first bag body; and a coupling portion that detachably couples the first bag body accommodated in the second bag body to the second bag body.

As an example, the coupling portion may include a bottom coupling portion that detachably couples a bottom of the first bag body and a bottom of the second bag body.

The bottom coupling portion may include a bottom coupling member having one end provided at a first portion of an outer bottom surface of the first bag body; a first bottom through hole that passes through the first portion of a bottom surface of the second bag body to pass the other end of the bottom coupling member from the inside to the outside of the second bag body; a second bottom through hole that passes through a second portion of the bottom surface of the second bag body to pass the other end of the bottom coupling member passing through the first bottom through hole from the outside to the inside of the second bag body; and a bottom fastener that fastens the other end of the bottom coupling member passing through the second bottom through hole to a second portion of the outer bottom surface of the first bag body.

As another example, the coupling portion may include a narrow side coupling portion that detachably couples a narrow side having a relatively small width of sides of the first bag body to a narrow side having a relatively small width of sides of the second bag body.

As yet another example, the coupling portion may include a bottom coupling portion that detachably couples a bottom of the first bag body and a bottom of the second bag body; and a narrow side coupling portion that detachably couples a narrow side having a relatively small width of sides of the first bag body to a narrow side having a relatively small width of sides of the second bag body.

As an example, the narrow side coupling portion may include a first narrow side coupling member having one end provided at an outer narrow side of the first bag body; a second narrow side coupling member having one end provided at an inner narrow side of the second bag body; and a narrow side fastener that fastens the other end of the first narrow side coupling member to the other end of the second narrow side coupling member.

One end of the first narrow side coupling member may be provided an upper part of the outer narrow side of the first bag body, and one end of the second narrow side coupling member may be provided a lower part of the inner narrow side of the second bag body.

As another example, the narrow side coupling portion may include a first narrow side coupling member having one end provided at an outer narrow side of the first bag body; a narrow side coupling ring provided at an outer narrow side of the second bag body and passing the other end of the narrow side coupling member; and a narrow side fastener that fastens the other end of the narrow side coupling member passing through the narrow side coupling ring to a middle portion of the narrow side coupling member.

As yet another example, the narrow side coupling portion may include a narrow side coupling member having one end provided at an outer upper surface of the first bag body; and a narrow side fastener that fastens the narrow side coupling member to an outer narrow side of the second bag body.

As still another example, the narrow side coupling portion may include a narrow side coupling member having one end provided at an outer narrow side of the second bag body; a narrow side coupling ring provided at an outer narrow side of the first bag body and passing the other end of the narrow side coupling member; and a narrow side fastener that fastens the other end of the narrow side coupling member passing through the narrow side coupling ring to a middle portion of the narrow side coupling member.

As still yet another example, the narrow side coupling portion may include a narrow side fastener that fastens directly an outer narrow side of the first bag body to an inner narrow side of the second bag body.

As still yet another example, the coupling portion may include a wide side coupling portion that detachably couples a wide side having a relatively large width of sides of the first bag body to a wide side having a relatively large width of sides of the second bag body.

As still yet another example, the coupling portion may include a bottom coupling portion that detachably couples a bottom of the first bag body and a bottom of the second bag body; and a wide side coupling portion that detachably couples a wide side having a relatively large width of sides of the first bag body to a wide side having a relatively large width of sides of the second bag body.

As still yet another example, the coupling portion may include a narrow side coupling portion having one end provided at an outer upper surface of the first bag body; and a narrow side fastener that fastens the narrow side coupling member to an outer narrow side of the second bag body; and a wide side coupling portion that detachably couples a wide side having a relatively large width of sides of the first bag body to a wide side having a relatively large width of sides of the second bag body.

As still yet another example, the coupling portion may include a bottom coupling portion that detachably couples a bottom of the first bag body and a bottom of the second bag body;

a narrow side coupling portion that detachably couples a narrow side having a relatively small width of sides of the first bag body to a narrow side having a relatively small width of sides of the second bag body; and a wide side coupling portion that detachably couples a wide side having a relatively large width of sides of the first bag body to a wide side having a relatively large width of sides of the second bag body.

As an example, the wide side coupling portion may include a wide side coupling member having one end provided at a first portion of an outer wide side of the first bag body; a first wide side through hole that passes through the first portion of the wide side of the second bag body to pass the other end of the wide side coupling member from the inside to the outside of the second bag body; a second wide side through hole that passes through a second portion of the wide side of the second bag body to pass the other end of the wide side coupling member passing through the first wide side through hole from the outside to the inside of the second bag body; and a wide side fastener that fastens the other end of the wide side coupling member passing through the second wide side through hole to a second portion of the outer wide side of the first bag body.

As another example, the wide side coupling portion may include a wide side fastener that fastens directly an outer wide side of the first bag body to an inner wide side of the second bag body.

As yet another example, the wide side coupling portion may include a wide side coupling member having one end provided at an outer upper surface of the first bag body; and a wide side fastener that fastens the wide side coupling member to the outer wide side of the second bag body.

Advantageous Effects

As described above, the changeable bag according to the exemplary embodiments of the present invention may have the following effects.

According to the exemplary embodiments of the present invention, since the technical configuration including the first bag body, the second bag body, and the coupling portion is provided, the first and second bag bodies are used, respectively, the first and second bag bodies are used to be coupled to each other, or the second bag body having a different color is used to be coupled to the first bag body to be changed into bags having various senses, that is, bags having different types, different shapes, and different colors, thereby pursuing individuality in a society where the individuality is important.

Particularly, it is possible to achieve ethical consumption, sustainable fashion, and reasonable consumption. For example, the essence of fashion is to pursue changes and one type of bag can have various functions to reduce vanity consumption, lead a new consumption culture by promoting a friendship of products, and revitalize various customer needs and broaden selection widths of the consumers. Furthermore, in conventional bags, materials, colors, weights, and the like are limited, but in the changeable bag of the present invention, materials, colors, shapes, weights, and the like can be custom-made variously according to a selection to be easily and rapidly order-made. Further, in the changeable bag of the present invention, the bag may be changed according to a weather change, a mood change, characteristics of contents (goods), and the like. Further, the conventional bag is integrally formed by attaching a |lead|[p1] to an outer surface to sew a lining together, but the changeable bag of the present invention may be separated and changed into a bag having a replaceable function. Further, anyone can easily create and experience a variety of styles at a reasonable cost according to a change, and everyone can use the bag by adopting an easy and simple coupling portion. In addition, fashion-conscious today, although the conventional bag can not be an alternative, the changeable bag of the present invention keeps a taste of the consumer and keeps a unique form while accepting a change constantly according to the age to be used comfortably and easily and can be held for a longer time. Further, according to the exemplary embodiment of the present invention, division of the labor can be performed according to an operating process, thereby enhancing efficiently a production amount.

DESCRIPTION OF DRAWINGS

FIG. 1 is an exploded view schematically illustrating a changeable bag according to a first exemplary embodiment of the present invention.

FIG. 2 illustrates an example of a bottom coupling portion, in which FIG. 2A is a diagram illustrating a bottom of a first bag body and FIG. 2B is a diagram illustrating a bottom of a second bag body.

FIG. 3 is a diagram illustrating the bottom of the second bag body in a state in which the first and second bag bodies are coupled to each other by the bottom coupling portion of FIG. 2.

FIG. 4 is a main cross-sectional view schematically illustrating the state in which the first and second bag bodies are coupled to each other by the bottom coupling portion of FIG. 3.

FIG. 5 illustrates another example of a bottom coupling portion, in which FIG. 5A is a diagram illustrating a bottom of a first bag body and FIG. 5B is a diagram illustrating a bottom of a second bag body.

FIG. 6 is a diagram illustrating the bottom of the second bag body in a state in which the first and second bag bodies are coupled to each other by the bottom coupling portion of FIG. 5.

FIG. 7 illustrates yet another example of a bottom coupling portion, in which FIG. 7A is a diagram illustrating a bottom of a first bag body and FIG. 7B is a diagram illustrating a bottom of a second bag body.

FIG. 8 is a diagram illustrating the bottom of the second bag body in a state in which the first and second bag bodies are coupled to each other by the bottom coupling portion of FIG. 7.

FIG. 9 is an exploded view schematically illustrating a process of coupling a changeable bag according to a second exemplary embodiment of the present invention.

FIG. 10 illustrates an example of a narrow side coupling portion, in which FIG. 10A is a diagram illustrating an outer narrow side of a first bag body and FIG. 10B is a diagram illustrating an inner narrow side of a second bag body.

FIG. 11 is a main cross-sectional view schematically illustrating a state in which the first and second bag bodies are coupled to each other by the narrow side coupling portion of FIG. 10.

FIG. 12 is a main cross-sectional view schematically illustrating a state in which the first and second bag bodies are coupled to each other by another narrow side coupling portion.

FIG. 13 is a diagram illustrating the outer narrow side of the second bag body in a state in which the first and second bag bodies are coupled to each other by the narrow side coupling portion of FIG. 12.

FIG. 14 is a main cross-sectional view schematically illustrating a state in which the first and second bag bodies are coupled to each other by yet another narrow side coupling portion.

FIG. 15 is a diagram illustrating the outer narrow side of the second bag body in a state in which the first and second bag bodies are coupled to each other by the narrow side coupling portion of FIG. 14.

FIG. 16 is a main cross-sectional view schematically illustrating a state in which the first and second bag bodies are coupled to each other by still another narrow side coupling portion.

FIG. 17 is a main cross-sectional view schematically illustrating a state in which the first and second bag bodies are coupled to each other by still yet another narrow side coupling portion.

FIG. 18 is an exploded view schematically illustrating a process of coupling a changeable bag according to a third exemplary embodiment of the present invention.

FIG. 19 illustrates an example of a wide side coupling portion, in which FIG. 19A is a diagram illustrating an outer wide side of a first bag body and FIG. 19B is a diagram illustrating an inner wide side of a second bag body.

FIG. 20 is a diagram illustrating the outer wide side of the second bag body in a state in which the first and second bag bodies are coupled to each other by the wide side coupling portion of FIG. 19.

FIG. 21 is a main cross-sectional view schematically illustrating a state in which the first and second bag bodies are coupled to each other by another wide side coupling portion.

FIG. 22 is a main cross-sectional view schematically illustrating a state in which the first and second bag bodies are coupled to each other by yet another wide side coupling portion.

FIG. 23 is a diagram illustrating the outer wide side of the second bag body in a state in which the first and second bag bodies are coupled to each other by the wide side coupling portion of FIG. 22.

MODES OF THE INVENTION

The present invention will be described more fully hereinafter with reference to the accompanying drawings, in which exemplary embodiments of the invention are shown. However, the present invention can be realized in various different forms, and is not limited to the exemplary embodiments described herein.

FIG. 1 is an exploded view schematically illustrating a changeable bag according to a first exemplary embodiment of the present invention, FIG. 2 illustrates an example of a bottom coupling portion, in which FIG. 2A is a diagram illustrating a bottom of a first bag body and FIG. 2B is a diagram illustrating a bottom of a second bag body, FIG. 3 is a diagram illustrating the bottom of the second bag body in a state in which the first and second bag bodies are coupled to each other by the bottom coupling portion of FIG. 2, and FIG. 4 is a main cross-sectional view schematically illustrating the state in which the first and second bag bodies are coupled to each other by the bottom coupling portion of FIG. 3.

A changeable bag according to a first exemplary embodiment of the present invention includes a first bag body 110, a second bag body 120, and a coupling portion E1, as illustrated in FIGS. 1 to 4. Hereinafter, respective components will be described in detail with reference to FIGS. 1 to 4.

The first bag body 110 has a first accommodating portion (not illustrated). For example, as illustrated in FIG. 1, the first bag body 110 may have a shape such as a pouch without a handle or the like. Furthermore, the first bag body 110 may further include a first upper opening portion (see 111) which communicates with the first accommodating portion (not illustrated) to continuously open a side and an upper surface and a zipper 111 opening and closing the first upper opening portion.

Particularly, the first bag body 110 may also be used in a pouch form in a state in which the first bag body 110 is not coupled with the second bag body 120. Furthermore, the first bag body 110 may be prepared in various colors to provide various senses when coupled with the second bag body 120.

The second bag body 120 has a second accommodating portion (not illustrated) accommodating the first bag body 110 as illustrated in FIG. 1. Furthermore, as illustrated in FIG. 1, the second bag body 120 may further include a second upper opening portion 122 of which the side and the upper surface are continuously opened to correspond to the first upper opening portion (see 111), that is, so that the zipper 111 of the first bag body 110 may be exposed to the outside. Accordingly, the user may open and close the zipper 111 of the first bag body 110 by the second upper opening portion 122.

Further, the second bag body 120 may further include a lower edge opening portion 123 as illustrated in FIG. 1. The lower edge opening portion 123 may be formed by passing through a lower edge of the second bag body 120 so that the lower edge of the first bag body 110 is viewed from the outside when the first bag body 110 is accommodated in the second accommodating portion 121. Accordingly, when the first bag body 110 is coupled with the second bag body 120, it is possible to provide various senses by the lower edge opening portion 123.

Meanwhile, the second bag body 120 may also have a tote bag type with a handle as an example as illustrated in FIG. 1, also have a shoulder bag type with a shoulder strap (not illustrated) as another example, and also have a pouch type without a handle or a shoulder strap as yet another example (not illustrated). Accordingly, the second bag body 120 may also be used as a tote bag, a shoulder bag, or a pouch in which while the first bag body 110 is not accommodated or the first bag body 110 is accommodated.

The coupling portion E1 serves to detachably couple the first bag body 110 accommodated in the second bag body 120 to the second bag body 120, as illustrated in FIGS. 2 to 4. For example, the coupling portion E1 may include a bottom coupling portion 130 which detachably couples a bottom of the first bag body 110 and a bottom of the second bag body 120 to each other.

The bottom coupling portion 130 may include a bottom coupling member 131, a first bottom through hole 133, a second bottom through hole 134, and a bottom fastener 132 as illustrated in FIGS. 2 to 4.

The bottom coupling member 131 has a band shape and one end provided on a first portion of an outer bottom surface of the first bag body 110 by a backstitch P. The first bottom through hole 133 passes through a first portion of a bottom surface of the second bag body 120 to pass the other end of the bottom coupling member 131 from the inside to the outside of the second bag body 120. The second bottom through hole 134 passes through a second portion of a bottom surface of the second bag body 120 to pass the other end of the bottom coupling member 131 from the outside to the inside of the second bag body 120. In addition, the bottom fastener 132 may fasten the other end of the bottom coupling member 131 passing through the second bottom through hole 134 to the second portion of the outer bottom surface of the first bag body 110.

Furthermore, as an example, the bottom fastener 132 may also be a snap fastener 132 including a female button 132*a* having a concave surface provided at the other end of the bottom coupling member 131 and a male button 132*b* having a convex surface provided on the bottom of the first bag body 110 to correspond to the female button 132*a* as illustrated in FIG. 4. Although not illustrated, as another example, the female button 132*a* is provided on the bottom of the first bag body 110 and the male button 132*b* may also be provided at the other end of the patch member 131. Although not illustrated, as yet another example, the bottom fastener 132 may also be a magnetic fixture including a first magnet instead of the female button 132*a* and a second magnet having an opposite polarity to the first magnet instead of the male button 132*b*. Although not illustrated, as still another example, the bottom fastener 132 may also be a velcro and although not illustrated, as still yet another example, the bottom fastener 132 may also be a buckle.

Accordingly, when the user fastens the bottom fastener 132 by passing the bottom coupling member 131 through the first bottom through hole 133 and then passing the bottom fastener 132 through the second bottom through hole 134, the first bag body 110 may be fastened to the second bag body 120.

Further, before the first bag body 110 is coupled to the second bag body 120, as illustrated in FIG. 1, when the bottom coupling member 131 is directly fastened to the first bag body 110 so that the bottom of the first bag body 110 is placed on an external object (not illustrated), the bottom coupling member 131 may also serve to prevent the bottom of the first bag body 110 from coming into direct contact with an external object to be messy. In addition, after the first bag body 110 is coupled to the second bag body 120, as illustrated in FIG. 1, when the bottom coupling member 131 has a stepped shape with the bottom of the second bag body 120 so that the bottom of the second bag body 120 is placed on the external object (not illustrated), the bottom coupling member 131 may also serve to prevent the bottom of the second bag body 120 from coming into direct contact with an external object to be messy.

As described above, since the technical configuration including the first bag body 110, the second bag body 120, and the bottom coupling portion 130 is provided, the first and second bag bodies 110 and 120 are used, respectively, the first and second bag bodies 110 and 120 are used to be coupled to each other, or the second bag body 120 having a different color is used to be coupled to the first bag body 110 to be changed into bags having various senses, that is, bags having different types, different shapes, different colors, or the like, thereby pursuing individuality in a society where the individuality is important. Furthermore, since the bottom coupling member 131 in which one end of the first bag body 110 is fixed is fastened to the first bag body 110 by passing through the second bag body 120 to provide the bottom coupling portion 130, the first and second bag bodies 110 and 120 may be firmly fastened to each other.

Hereinafter, a changeable bag according to a modified example of the first exemplary embodiment of the present invention will be described with reference to FIGS. 5 and 6.

FIG. 5 illustrates another example of a bottom coupling portion, in which FIG. 5A is a diagram illustrating a bottom of a first bag body and FIG. 5B is a diagram illustrating a bottom of a second bag body, and FIG. 6 is a diagram illustrating the bottom of the second bag body in a state in which the first and second bag bodies are coupled to each other by the bottom coupling portion of FIG. 5.

Since a changeable bag according to a modified example of the first exemplary embodiment of the present invention is the same as the first exemplary embodiment of the present invention described above except for a position of a bottom coupling portion 1130 as illustrated in FIGS. 5 and 6, the position of the bottom coupling portion 1130 will be mainly hereinafter described.

As illustrated in FIGS. 5 and 6, a bottom coupling member 1131 is traversed in a longitudinal direction of the bottom surface of the first bag body 110, one end thereof may be fixed to a portion adjacent to a first wide side of the outer bottom surface of the first bag body 110, and the other end thereof may be positioned at a portion adjacent to a second wide side of the outer bottom surface of the first bag body 110. First and second bottom through holes 1133 and 1134 may be formed at the portions adjacent to the first and second wide sides of the bottom surface of the second bag body 120, respectively.

Hereinafter, a changeable bag according to another modified example of the first exemplary embodiment of the present invention will be described with reference to FIGS. 7 and 8.

FIG. 7 illustrates yet another example of a bottom coupling portion, in which FIG. 7A is a diagram illustrating a bottom of a first bag body and FIG. 7B is a diagram illustrating a bottom of a second bag body and FIG. 8 is a diagram illustrating the bottom of the second bag body in a state in which the first and second bag bodies are coupled to each other by the bottom coupling portion of FIG. 7.

Since a changeable bag according to another modified example of the first exemplary embodiment of the present invention is the same as the first exemplary embodiment of the present invention described above except for a position of a bottom coupling portion 2130 as illustrated in FIGS. 7 and 8, the position of the bottom coupling portion 2130 will be mainly hereinafter described.

As illustrated in FIGS. 7 and 8, a bottom coupling member 2131 is disposed in a longitudinal direction of the bottom surface of the first bag body 110, one end thereof may be fixed to a first portion of the outer bottom surface of the first bag body 110, and the other end thereof may be fixed to a second portion of the outer bottom surface of the first bag body 110. First and second bottom through holes 2133 and 2134 may be formed at the first and second portions of the bottom surface of the second bag body 120, respectively.

Hereinafter, a changeable bag 200 according to a second exemplary embodiment of the present invention will be described with reference to FIGS. 9 to 11.

FIG. 9 is an exploded view schematically illustrating a process of coupling a changeable bag according to a second exemplary embodiment of the present invention, FIG. 10 illustrates an example of a narrow side coupling portion, in which FIG. 10A is a diagram illustrating an outer narrow side of a first bag body and FIG. 10B is a diagram illustrating an inner narrow side of a second bag body, and FIG. 11 is a main cross-sectional view schematically illustrating a state in which the first and second bag bodies are coupled to each other by the narrow side coupling portion of FIG. 10.

Since a changeable bag 200 according to a second exemplary embodiment of the present invention is the same as the first exemplary embodiment of the present invention described above except for a coupling portion E2 as illustrated in FIGS. 9 to 11, a position of the coupling portion E2 will be mainly hereinafter described.

The coupling portion E2 may include a narrow side coupling portion 230 that detachably couples a narrow side having a relatively small width of sides of a first bag body 210 and a narrow side having a relatively small width of sides of a second bag body 220.

The narrow side coupling portion 230 may include a first narrow side coupling member 231, a second narrow side coupling member 232, and a narrow side fastener 233 as illustrated in FIGS. 10 and 11. The first narrow side coupling member 231 may have one end provided at an outer narrow side of the first bag body 210, the second narrow side coupling member 232 may have one end provided at an inner narrow side of the second bag body 220, and the narrow side fastener 233 may fasten the other end of the first narrow side coupling member 231 to the other end of the second narrow side coupling member 232.

Particularly, one end of the first narrow side coupling member 231 may be provided on the outer narrow side of the first bag body 210 and one end of the second narrow side coupling member 232 may be provided below the inner narrow side of the second bag body 220. Accordingly, even though the first bag body 210 is separated from the second bag body 220, there is an advantage that the first narrow side coupling member 231 is stacked from the top to the bottom to be seen as one decoration in terms of a design.

Furthermore, the narrow side fastener 233 may also be a velcro including a female velcro 233*a* (referred to as a softer) provided on the first narrow side coupling member 231 and a male velcro 233*b* (referred to as a rougher) provided on the second narrow side coupling member 232 as illustrated in FIG. 10 as an example, a snap fastener (not illustrated) as another example, a magnetic fixture using magnetic force (not illustrated) as yet another example, and a buckle (not illustrated) as still another example.

Hereinafter, a changeable bag according to a modified example of the second exemplary embodiment of the present invention will be described with reference to FIGS. 12 and 13.

FIG. 12 is a main cross-sectional view schematically illustrating a state in which the first and second bag bodies are coupled to each other by another narrow side coupling portion and FIG. 13 is a diagram illustrating the outer narrow side of the second bag body in a state in which the first and second bag bodies are coupled to each other by the narrow side coupling portion of FIG. 12.

Since a changeable bag according to a modified example of the second exemplary embodiment of the present invention is the same as the second exemplary embodiment of the present invention described above except for a narrow side coupling portion 1230 as illustrated in FIGS. 12 and 13, a position of the narrow side coupling portion 1230 will be mainly hereinafter described.

The narrow side coupling portion 1230 may include a narrow side coupling member 1231, a narrow side coupling ring 1232, and a narrow side fastener 1233 as illustrated in FIGS. 12 and 13. The narrow side coupling member 1231 may have one end provided at an outer narrow side of the first bag body 210, the narrow side coupling ring 1232 is provided at an outer narrow side of the second bag body 220 and may pass through the other end of the narrow side coupling member 1231, and the narrow side fastener 1233 may fasten the other end of the narrow side coupling member 1231 passing through the narrow side coupling ring 1232 to a middle portion of the narrow side coupling member 1231.

Herein, since the narrow side fastener 1233 is the same as the narrow side fastener 233 described in the second exemplary embodiment of the present invention, the detailed description will be omitted.

Hereinafter, a changeable bag according to another modified example of the second exemplary embodiment of the present invention will be described with reference to FIGS. 14 and 15.

FIG. 14 is a main cross-sectional view schematically illustrating a state in which the first and second bag bodies are coupled to each other by yet another narrow side coupling portion, and FIG. 15 is a diagram illustrating the outer narrow side of the second bag body in a state in which the first and second bag bodies are coupled to each other by the narrow side coupling portion of FIG. 14.

Since a changeable bag according to another modified example of the second exemplary embodiment of the present invention is the same as the second exemplary embodiment of the present invention described above except for a narrow side coupling portion 2230 as illustrated in FIGS. 14 and 15, a position of the narrow side coupling portion 2230 will be mainly hereinafter described.

The narrow side coupling portion 2230 may include a narrow side coupling member 2231 and a narrow side fastener 2232 as illustrated in FIGS. 14 and 15. The narrow side coupling member 2231 may have one end provided on the outer upper surface of the first bag body 210 and the narrow side fastener 2232 may fasten the narrow side coupling member 2231 to the outer narrow side of the second bag body 220.

Herein, when the first bag body 210 is separated from the second bag body 220, the narrow side coupling member 2231 may serve as a handle of the first bag body 210. Further, since the narrow side fastener 2232 is the same as the narrow side fastener 233 described in the second exemplary embodiment of the present invention, the detailed description will be omitted.

Hereinafter, a changeable bag according to yet another modified example of the second exemplary embodiment of the present invention will be described with reference to FIG. 16.

FIG. 16 is a main cross-sectional view schematically illustrating a state in which the first and second bag bodies are coupled to each other by still yet another narrow side coupling portion.

Since a changeable bag according to yet another modified example of the second exemplary embodiment of the present invention is the same as the second exemplary embodiment of the present invention described above except for a narrow side coupling portion 3230 as illustrated in FIG. 16, a position of the narrow side coupling portion 3230 will be mainly hereinafter described.

The narrow side coupling portion 3230 may include a narrow side coupling member 3231, a narrow side coupling ring 3232, and a narrow side fastener 3233 as illustrated in FIG. 16. The narrow side coupling member 3231 may have one end provided at an outer narrow side of the second bag body 220, the narrow side coupling ring 3232 is provided at an outer narrow side of the first bag body 210 and may pass through the other end of the narrow side coupling member 3231, and the narrow side fastener 3233 may fasten the other end of the narrow side coupling member 3231 passing through the narrow side coupling ring 3232 to a middle portion of the narrow side coupling member 3231.

Herein, since the narrow side fastener 3233 is the same as the narrow side fastener 233 described in the second exemplary embodiment of the present invention, the detailed description will be omitted.

Hereinafter, a changeable bag according to still another modified example of the second exemplary embodiment of the present invention will be described with reference to FIG. 17.

FIG. 17 is a main cross-sectional view schematically illustrating a state in which the first and second bag bodies are coupled to each other by still yet another narrow side coupling portion.

Since a changeable bag according to still another modified example of the second exemplary embodiment of the present invention is the same as the second exemplary embodiment of the present invention described above except for a narrow side coupling portion 4230 as illustrated in FIG. 17, a position of the narrow side coupling portion 4230 will be mainly hereinafter described.

The narrow side coupling portion 4230 may include a narrow side fastener 4231 that directly fastens an outer narrow side of the first bag body 210 to an inner narrow side of the second bag body 220 as illustrated in FIG. 17.

Herein, since the narrow side fastener 4231 is the same as the narrow side fastener 233 described in the second exemplary embodiment of the present invention, the detailed description will be omitted.

Hereinafter, a changeable bag 300 according to a third exemplary embodiment of the present invention will be described with reference to FIGS. 18 to 20.

FIG. 18 is an exploded view schematically illustrating a process of coupling a changeable bag according to a third exemplary embodiment of the present invention, FIG. 19 illustrates an example of a wide side coupling portion, in which FIG. 19A is a diagram illustrating an outer wide side of a first bag body and FIG. 19B is a diagram illustrating an inner wide side of a second bag body, and FIG. 20 is a diagram illustrating the outer wide side of the second bag body in a state in which the first and second bag bodies are coupled to each other by the wide side coupling portion of FIG. 19.

Since a changeable bag 300 according to a third exemplary embodiment of the present invention is the same as the first exemplary embodiment of the present invention described above except for a coupling portion E3 as illustrated in FIGS. 18 to 20, a position of the coupling portion |E3|[p2] will be mainly hereinafter described.

The coupling portion |E3|[p3] may include a wide side coupling portion 330 that detachably couples a wide side having a relatively large width of sides of a first bag body 310 and a wide side having a relatively large width of sides of the second bag body 320.

The wide side coupling portion 330 may include a wide side coupling member 331, a first wide side through hole 332, a second wide side through hole 333, and a wide side fastener 334 as illustrated in FIGS. 18 to 20. The wide side coupling member 331 may have one end provided on a first portion of an outer wide side of the first bag body 310, the first wide side through hole 332 passes through the first portion of the wide side of the second bag body 320 to pass the other end of the wide side coupling member 331 from the inside to the outside of the second bag body 320. The second wide side through hole 333 passes through a second portion of a wide side of the second bag body 320 to pass the other end of the wide side coupling member 331 passing through the first wide side through hole 332 from the outside to the inside of the second bag body 320. In addition, the wide side fastener 334 may fasten the other end of the wide side coupling member 331 passing through the second wide side through hole 333 to the second portion of the outer wide side of the first bag body 310.

Furthermore, the wide side fastener 334 may also be a velcro including a female velcro (referred to as a softer) provided on the wide side coupling member 331 and a male velcro (referred to as a rougher) provided on the second portion of the outer wide side of the first bag body 310 although not illustrated as an example, a snap fastener (not illustrated) as another example, a magnetic fixture using magnetic force (not illustrated) as yet another example, and a buckle (not illustrated) as still another example.

Hereinafter, a changeable bag according to a modified example of the third exemplary embodiment of the present invention will be described with reference to FIG. 21.

FIG. 21 is a main cross-sectional view schematically illustrating a state in which the first and second bag bodies are coupled to each other by another wide side coupling portion.

Since a changeable bag according to a modified example of the third exemplary embodiment of the present invention is the same as the third exemplary embodiment of the present invention described above except for a wide side coupling portion 1330 as illustrated in FIG. 21, a position of the wide side coupling portion 1330 will be mainly hereinafter described.

The wide side coupling portion 1330 may include a wide side fastener 1331 that directly fastens an outer wide side of the first bag body 310 to an inner wide side of the second bag body 320 as illustrated in FIG. 21.

Herein, since the wide side fastener 1331 is the same as the wide side fastener 334 described in the third exemplary embodiment of the present invention, the detailed description will be omitted.

Hereinafter, a changeable bag according to another modified example of the third exemplary embodiment of the present invention will be described with reference to FIGS. 22 and 23.

FIG. 22 is a main cross-sectional view schematically illustrating a state in which the first and second bag bodies are coupled to each other by yet another wide side coupling portion, and FIG. 23 is a diagram illustrating the outer wide side of the second bag body in a state in which the first and second bag bodies are coupled to each other by the wide side coupling portion of FIG. 22.

Since a changeable bag according to another modified example of the third exemplary embodiment of the present invention is the same as the third exemplary embodiment of the present invention described above except for a wide side coupling portion 2330 as illustrated in FIGS. 22 and 23, a position of the wide side coupling portion 2330 will be mainly hereinafter described.

The wide side coupling portion 2330 may include a wide side coupling member 2331 and a wide side fastener 2332 as illustrated in FIGS. 22 and 23. The wide side coupling member 2331 may have one end provided on the outer upper surface of the first bag body 310 and the wide side fastener 2332 may fasten the wide side coupling member 2331 to the outer wide side of the second bag body 320.

Herein, when the first bag body 310 is separated from the second bag body 320, the wide side coupling member 2331 may serve as a handle of the first bag body 310. Further, since the wide side fastener 2332 is the same as the wide side fastener 334 described in the third exemplary embodiment of the present invention, the detailed description will be omitted.

Meanwhile, if necessary, the bottom coupling portion described in the first exemplary embodiment of the present invention described above and the narrow side coupling portion described in the second exemplary embodiment may be used together, the bottom coupling portion described in the first exemplary embodiment of the present invention described above and the wide side coupling portion described in the third exemplary embodiment may also be used together, and the narrow side coupling portion described in the second exemplary embodiment of the present invention described above and the wide side coupling portion described in the third exemplary embodiment may also be used together. In addition, the bottom coupling portion described in the first exemplary embodiment of the present invention described above, the narrow side coupling portion described in the second exemplary embodiment, and the wide side coupling portion described in the third exemplary embodiment may also be used together.

As described above, the preferred exemplary embodiments have been described in detail, but it will be understood that the scope of the present invention is not limited thereto and includes various modifications and improvements by those skilled in the art using basic concepts of the present invention defined in the appended claims.

INDUSTRIAL AVAILABILITY

The present invention relates to a changeable bag and has industrial availability.

The invention claimed is:

1. A changeable bag, comprising:

a first bag body having a first accommodating portion;

a second bag body having a second accommodating portion accommodating the first bag body; and a coupling portion that detachably couples the first bag body accommodated in the second bag body to the second bag body, the coupling portion having a narrow side coupling portion that detachably couples a narrow side having a relatively small width of sides of the first bag body to a narrow side having a relatively small width of sides of the second bag body, wherein the narrow side coupling portion includes:

a narrow side coupling member having one end provided at an outer upper surface of the first bag body;

a narrow side fastener that fastens the narrow side coupling member to an outer narrow side of the second bag body; and a narrow side coupling ring provided at an outer narrow side of the first or the second bag body and passing the other end of the narrow side coupling member, wherein the narrow side fastener that fastens the other end of the narrow side coupling member passing through the narrow side coupling ring to a middle portion of the narrow side coupling member.

2. The changeable bag of claim 1, wherein the coupling portion includes a wide side coupling portion that detachably couples a wide side having a relatively large width of sides of the first bag body to a wide side having a relatively large width of sides of the second bag body.

3. A changeable bag, comprising:

a first bag body having a first accommodating portion;

a second bag body having a second accommodating portion accommodating the first bag body; and a coupling portion that detachably couples the first bag body accommodated in the second bag body to the second bag body, the coupling portion having a narrow side coupling portion that detachably couples a narrow side having a relatively small width of sides of the first bag body to a narrow side having a relatively small width of sides of the second bag body, wherein the narrow side coupling portion includes:

a narrow side coupling member having one end provided at an outer upper surface of the first bag body; and a narrow side fastener that fastens the narrow side coupling member to an outer narrow side of the second bag body, wherein the coupling portion includes a wide side coupling portion that detachably couples a wide side having a relatively large width of sides of the first bag body to a wide side having a relatively large width of sides of the second bag body, and wherein the wide side coupling portion includes a wide side coupling member having one end provided at a first portion of an outer wide side of the first bag body;

a first wide side through hole that passes through the first portion of the wide side of the second bag body to pass the other end of the wide side coupling member from the inside to the outside of the second bag body;

a second wide side through hole that passes through a second portion of the wide side of the second bag body to pass the other end of the wide side coupling member passing through the first wide side through hole from the outside to the inside of the second bag body; and a wide side fastener that fastens the other end of the wide side coupling member passing through the second wide side through hole to a second portion of the outer wide side of the first bag body.

* * * * *